United States Patent [19]

Kloczewski et al.

[11] 4,258,646

[45] Mar. 31, 1981

[54] PRESSURIZED WIRE ENAMEL APPLICATOR CELL

[75] Inventors: Harold A. Kloczewski, Pasadena; Cheryl N. Schaeffer, Baltimore, both of Md.

[73] Assignee: W. R. Grace & Co., New York, N.Y.

[21] Appl. No.: 76,963

[22] Filed: Sep. 20, 1979

[51] Int. Cl.[3] ..... B05C 3/172; B05D 3/06

[52] U.S. Cl. ..... 118/50.1; 118/405; 118/DIG. 18

[58] Field of Search ..... 118/DIG. 18, DIG. 19, 118/405, 50, 420, 50.1, 125; 427/60, 61, 111, 112, 117–120, 294–296, 356–358

[56] References Cited

U.S. PATENT DOCUMENTS

| | | | |
|---|---|---|---|
| 1,805,145 | 5/1931 | Koops | 118/50 |
| 1,826,297 | 10/1931 | Apple | 118/405 X |
| 2,199,067 | 4/1940 | Bradt | 118/405 |
| 2,280,415 | 4/1942 | Larmuth | 118/DIG. 18 |
| 2,366,077 | 12/1944 | Wildy et al. | 118/405 X |
| 2,868,159 | 1/1959 | Lit et al. | 118/125 |
| 3,227,577 | 1/1966 | Baessler et al. | 118/420 X |
| 3,354,864 | 11/1967 | Knapp | 118/405 X |
| 3,412,709 | 11/1968 | Goyffon | 118/405 |
| 3,424,130 | 1/1969 | Brynes et al. | 118/405 |
| 3,840,384 | 10/1974 | Reade et al. | 118/405 X |
| 3,882,819 | 5/1975 | Skeeters | 118/405 |
| 3,952,552 | 4/1976 | Rozner | 118/405 X |
| 4,117,196 | 9/1978 | Mathias | 427/54.1 X |

*Primary Examiner*—Morris Kaplan

*Attorney, Agent, or Firm*—Richard P. Plunkett; William W. McDowell, Jr.

[57] ABSTRACT

A cell for coating enamel onto wire, including radiation curable polymers (RCP), which accomodates a plurality of wires simultaneously. The wires are first subjected to vacuum degassing, and then pass through a single seal plate into a pressurized enamel chamber which assures a concentric coating of enamel onto the wire as it exits through a die plate having a separate cavity for each wire. Floating seals are provided at the entrance of the wire into the cell. The coated wire is then radiation cured conventionally.

12 Claims, 4 Drawing Figures

PRESSURIZED WIRE ENAMEL APPLICATOR CELL

Figure 1:
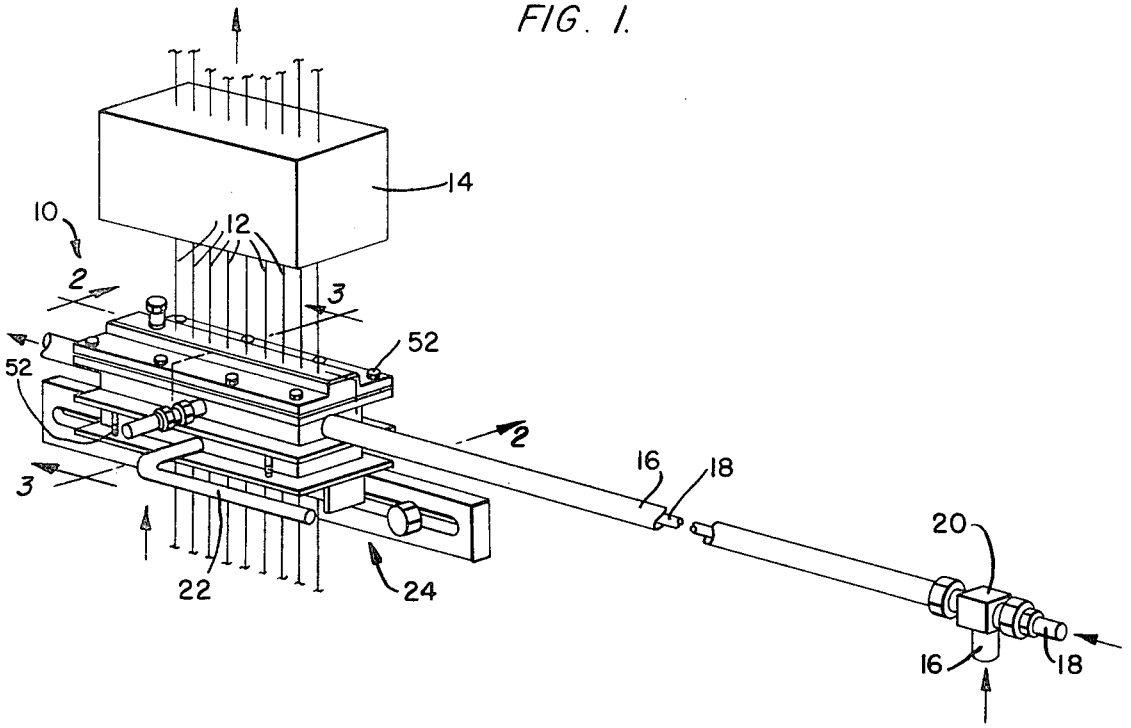

This application is related to companion applications Ser. No. 76,962, entitled "Pressure-Vacuum Enamel Coating of Wire", inventor Harold Adrian Kloczewski; and Ser. No. 76,965, entitled "Pressurized Wire Enamel Applicator With Self-aligning Seals", inventor Cheryl Nelson Schaeffer; both filed on the same day, owned by the same assignee, and having the same disclosure, as this application.

This invention pertains to the manufacture of insulated wire. More in particular, the invention concerns an improved method and apparatus to coat such wires with a radiation curable polymer (RCP) in order to achieve the advantages of such coating materials as opposed to conventional thermally cured enamels. "Enamel" is a term of this art which includes all materials, including RCPs, used to coat wire and also the application process, and it shall be so used and understood throughout this specification and claims.

The invention can be used to coat wire of any kind, and to make wire for any end use. For example, the invention has been used to make low temperature solderable wire, magnet wire (the wire used to make electro-magnets, motors, alternators, etc.), color coded wire, and geophysical wire. In addition, it is thought that the invention can be used to coat wire for use as rocket control cable (TOW missils), recoating wires of many different sorts to improve their properties, hook up wire, bell wire, telephone wire, all sorts of conventional wires, and all sorts of wire materials, including wires made of copper, aluminimum and steel. Most generally, the invention can also be used to coat materials which are not wire in the traditional sense but are wire-like in nature, such as fine tubing, optical products, optical fibers, and many other materials.

While the invention was developed for use particularly with RCPs, it is thought that it can also be used with the newly evolving more viscous conventional enamels. The solvents used in conventional enamels are relatively expensive and oppressive to use, and thus the conventional prior art is developing enamels which have less solvent and more solids and thus appear, to the invention, the same as the RCPs in that they are highly viscous. Further, the invention can also be used with the thinner materials depending upon the demands and constrictions of the end use of the so coated wire. For example, if a wire is to be coated only for decorative purposes and film integrity is not critical, it is possible that relatively thin enamels could be coated onto the wire despite the fact that the coating would be pinholed and unacceptable for electrical use, but completely acceptable for its decorative qualities. There are also RCPs having viscosities comparable to the thinner conventional enamels. Thus, the term "enamel" as defined above should be understood to include all materials including existing conventional materials, RCPs, and perhaps other materials presently unknown, which can be used in the invention to coat wire for different applications.

Some conventional materials used for wire coating are relatively thin liquids, and contain solids in the vicinity of 20% to 40% entrained in solvents. The methodology comprises multiple passes of the wire through baths of this material, with heating in-between to drive off the solvent to leave the coating on the wire. Typically, between 6 and 16 such passes and separate heatings are required in order to produce acceptably coated wire. This process is highly undesirable because of the relatively large amounts of energy required for the heating steps between the coating steps of the multi-pass operation.

RCPs are well known as being curable with use of radiation such as ultraviolet light, thus greatly decreasing the energy consumption of the wire coating process. RCPs used for wire coating are generally very viscous, in the vicinity of 150,000 cps for example. Conventional enamels for wire can be of very low viscosity, typically in the vicinity of 200–500 cps. High viscosity enamels stay on the wire where they are put, whereas thin enamels tend to flow and "tear-drop". Thus, it is possible to create a thick dielectric coating in one or two passes with viscous enamels using the invention cell. However, the laying down of the enamel on the wire is quite critical, and the viscous enamel is not as "forgiving" of errors of concentricity, as are thin enamels. That is, if a viscous enamel is laid on the wire with the wire to one side in the coating, it will cure or complete that way, whereas a thin liquid coating will naturally tend to form a uniform thickness around the wire. Of course, the dry or completed conventional material coating will be very thin, requiring multiple passes to achieve the desired "build" or final coating thickness.

Since the coated wire is created in a very few passes, it is especially important that there be no gas laying on or clinging to the wire before the enamel is applied because such gas will make holes which will of course degrade the film integrity of the coating. This is not so much a problem with conventional enamel because the many coating layers overlay each other. Thus, pin holes in one layer will be covered by the second, and the pin holes in the second layer will be covered by the third, and so on.

The invention achieves these advantages and strides forward in the art by the steps of first vacuum de-gassing the wire, applying the enamel under pressure so that it forms a concentric coating of uniform thickness, and then immediately completing or curing the enamel on the wire. Satisfactory wire is achieved in this manner in as few as one or two passes through the apparatus.

The invention comprises a pressure-vacuum (PV) cell to carry out the above process, said cell having numerous advantages, including the use of a die plate as opposed to single dies at the exit end of the enamel chamber, a single wall separating the vacuum chamber from the enamel chamber thus precluding the possibility of new gas adhering to the wire after the wire has been vacuum de-gassed, a set of floating seals at the entrance end of the vacuum chamber to facilitate the aligning and "stringing" of the cell prior to production, and a heat jacket around the enamel chamber to keep the enamel at the desired viscosity.

Thus, the invention permits much greater speed of operation and provides an improved die structure, which coupled with the PV cell, assures that the wire is centered in its relatively thick coat of enamel.

Yet another advantage, when RCP enamels are used, resides in the use of light as opposed to heat to complete by curing. A single chamber, with relatively few bulbs and a correspondingly small energy consumption, can cure virtually any number of RCP coated wires, so long as no wire shades any other wire from the light. This is as opposed to heat curing, wherein the number of BTU's supplied to the curing chamber must be shared by the number of wires to be cured. If more wires are cured simultaneously, more BTU's of heat must be put into that curing cell. Thus, the energy saving advantages of the invention are even further enhanced.

The seal between the vacuum and pressure chambers in the cell is critical. A sheet or plate of Teflon is currently preferred because of this material's good lubricity so as not to wear the wire, while at the same time being rugged so as to not itself be worn by the rapid passage of large amounts of wire.

The prior art coaters utilized separate so-called "bullet" and many other types of individual dies. This has the advantage of permitting replacement of one worn die. The invention, however, uses a single multiple-opening die plate, which has many advantages including facilitating the containment of the pressure on the enamel, fixing the correct orientation of all die openings, preventing inclusion of a wrong sized die in a set, and permitting higher throughput than some of the prior art.

Another advantage in the PV cell is the use of floating entry seals, as opposed to a fixed orifice at the entrance of the vacuum chamber. These seals permit their ready replacement, while at the same time greatly simplifying the aligning of the multi-passes of the wires through the cell during set up, i.e., "stringing" and start-up of the machine is greatly simplified.

Figure 2:
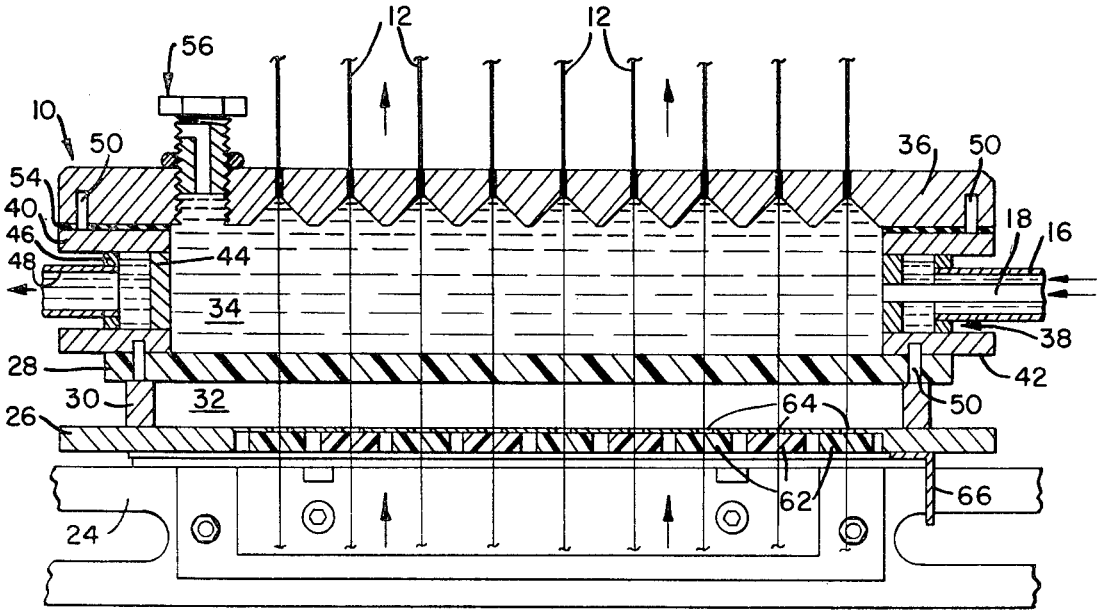
Figure 3:
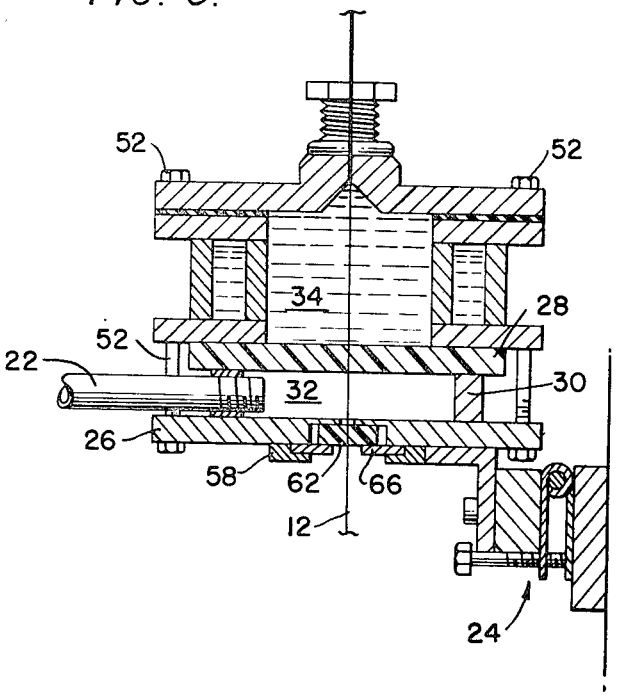
Figure 4:
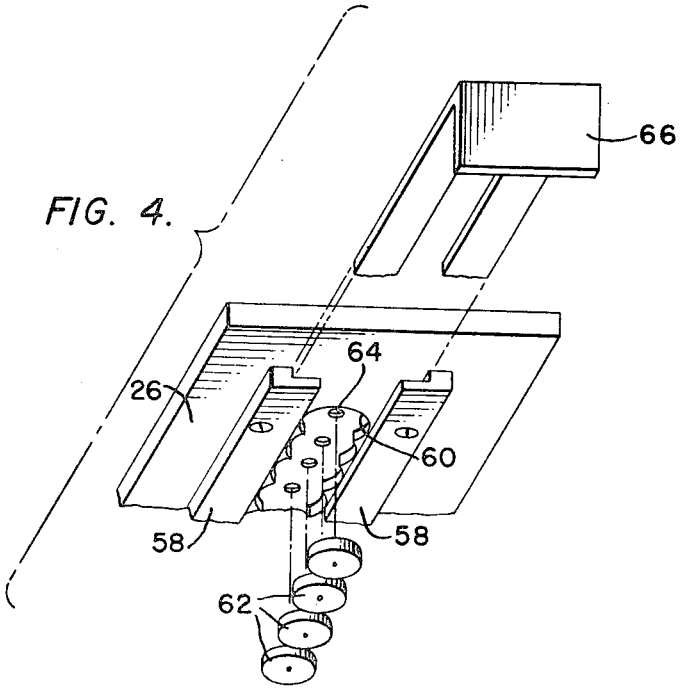

The above and other advantages of the invention will be pointed out or will become evident in the following detailed description and claims, and in the accompanying drawings also forming a part of the disclosure, in which:

FIG. 1 is a perspective view of a PV cell embodying the invention shown in use:

FIGS. 2 and 3 are cross-sectional views taken on lines 2—2 and 3—3 of FIG. 1 respectively, and FIG. 4 is an underside exploded view showing the wire entry floating seals.

Referring now in detail to the drawing, the invention comprises a PV cell 10 through which a plurality of wires to be coated pass. The wires travel, in the embodiment shown, from bottom to top through the cell, and thence to a curing means 14, which may comprise nothing more than a light box with ultraviolet bulbs. In any case, suitable curing or completing means are provided depending upon the particular enamel in use.

The invention cell has been used as shown in the drawings with vertical runs of wire, as opposed to horizontal runs, but this is not critical. It was done so that the developmental invention cell could be used with otherwise conventional vertical run wire coating equipment. The critical criteria for the invention, regardless of vertical or horizontal wire running, is that the wire not be subjected to any turning, twisting or the like on its way to be cured which could distort the enamel coating. That is, the curing or completing means should be, preferably, directly in line along the direction of travel of the wire as it exits the PV cell, in whatever orientation, with no change of wire direction.

Means are provided to supply enamel in a heated condition and under pressure to cell 10. To this end, a pair of nested pipes 16 and 18 are provided and terminate at a fitting 20. The inner pipe 18 contains the enamel and is nested within the larger pipe 16 which contains a heat transfer fluid, typically hot water, hot glycol, or the like. In this manner the enamel is delivered to the cell 10 at a predetermined desired elevated temperature at which its properties are best for coating this particular wire. Pump means not shown are provided to supply the enamel to its chamber at a predetermined pressure. The composite pipe 16-18 can have an indeterminate length, as indicated, with insulation around the outside being provided as necessary if the heat loss will be excessive.

The pressure aspect of the PV cell serves the function of assuring concentricity of the wire within its relatively thick enamel coating. The enamel in its part of the cell is pressurized in the range of slightly above 0 to about 30 psig, with a pressure of about 10 psig preferred. Since the enamel is pressurized, and the only escape for this pressure is through the die holes through which the wire exits the cell, and since nature naturally applies pressure equally all around a wire, the coating is forced to form a concentric coating around the wire at the die plate exit of the cell.

Means are provided to supply vacuum to the vacuum part of the cell, and to this end a pipe 22 connected to suitable vacuum pump means is provided. Similarly, means are provided to mount the cell 10 on a particular machine in use, and to this end an assemblage 24 of brackets, bolts and the like, to accomodate the invention cell to a particular wire coating machine, will be provided, as is within the skill of practioners of this art.

Referring now in detail to FIGS. 2 and 3, the wires to be coated enter device 10 through the floating seals described below and immediately encounter a vacuum chamber 32, after which they immediately encounter a chamber 34 filled with the enamel under pressure. The wires then exit the enamel chamber and pass on to curing means 14.

Vacuum chamber 32 is defined by a bottom plate 26, a top seal plate 28, and side wall means 30 extending all around to define the space 32. The vacuum pipe 22 enters through wall 30 as shown in FIG. 3. The seal plate 28 preferably comprises a sheet of Teflon formed with a suitably sized small opening to receive the particular size of wire 12 being operated upon, one hole for each wire, of course. Teflon has the advantage of permitting the wire to pass readily therethrough due to its lubricity, while at the same time not adversely effecting the wire as by scarring or marking; and also having a relatively long useful life because of its ruggedness and durability.

The enamel chamber is defined by the seal plate 28, a top die plate 36, and a water jacket assembly 38 therebetween. Assembly 38 comprises a top flange 40 and a bottom 42 held in spaced relation to each other by an inner wall 44 which is spaced from an outer wall 46. An exit pipe 48 (see FIG. 2) for the heat medium is provided in outer wall 46. The structure of the heat jacket 38 together with its pipes 16, 18 and 48 may be a single weldment. The heat medium exit pipe 48 can be delivered to waste or recycled conventionally. The assembly is completed by an array of locating pins 50 and screw assemblies 52 which join the flanges 40 and 42 of the heat jacket to the die plate and to the bottom plate 26 respectively to form a rigid assembly. A gasket 54 is provided between the die plate and the top flange 40. A vent device 56 is provided in the die plate 36 to permit complete filling of the die with enamel prior to the beginning of operation. It is, of course, necessary that there be no air in the chamber 34 to mix with or "bubble" the enamel in use. This is easily and automatically solved as the enamel delivered through the pipe 18 is under pressure, thus continually making up enamel as it is consumed by the wires 12. The vent 56 is shown in the open position for illustration, it will be closed during operation.

Means are provided to seal the entry of the wires into the vacuum chamber 32 and to facilitate the stringing of the machine at start-up. To this end (referring to FIGS. 2, 3 and 4) there is provided a pair of rails 58 on the underside of the bottom plate 26. Plate 26 between the rails is formed with recesses 60 adapted to receive plug or seal members 62 which fit loosely within the recesses, i.e., seals 62 are of a diameter substantially less than the diameter of the recesses so they can move readily therein. At the center of the recesses the bottom plate is formed with a plurality of openings 64 which are substantially larger than the diameter of the wire. Each seal 62 is formed with a sealing type opening similar to those formed in plate 28. Seals 62 also, incidentally, are formed of Teflon or other suitable material having the desired characteristics. In use, the wires are strung through the openings in the seal plate and the opening 64 in the bottom plate, the seals 62 being free to move during this operation. A guard or lock member 66 is provided, to fit snugly within the openings in the rails 58 as indicated in FIG. 4.

In use, the wire is strung up before the enamel is supplied and before the vacuum is applied, the seals 62 being loosely and easily movable within their recesses in the plate 26 at such time. When the machine is properly aligned, the vacuum is applied and the seals will automatically take on a fixed and aligned position. Thus, the seals 62 and surrounding structure facilitate start-up by providing a self aligning feature to permit the wires to pass straight through the immovable openings in the Teflon seal plate 28 and in the die plate. This feature greatly enhances the invention in use.

The invention uses a single plate with many orifices one for each of the plurality of wires, rather than a more complex means having individual dies. As to the shape, length, diameters, etc. of each die opening through the die plate which coats the individual wires, these parameters are well known to those skilled in the art and would in any case have to be adjusted for a particular set of circumstances, i.e., wire diameter, wire speed, enamel type, pressure used, coating thickness desired, and the like. The drawings show the general configuration used in developing the invention. More specifically, in coating annealed copper wire, size 24 AWG, a cone diameter of about 60° and a throat length of one-quarter to three-eighths of an inch were successfully used with an RCP having a viscosity of about 150,000 cps at room temperature.

While the invention has been described in detail above, it is to be understood that this detailed description is by way of example only, and the protection granted is to be limited only within the spirit of the invention and the scope of the following claims.

We claim:

1. A cell for coating enamel onto a plurality of strands of bare wire in a continuous operation, said cell comprising a first vacuum chamber arranged vertically in tandem with a second externally pressurized, heat jacketed enamel chamber in the direction of wire motion through said cell, first movable seal means to permit entry of the wire into said vacuum chamber comprising an individual seal member of disc-like configuration for each wire at the entrance end of said vacuum chamber, each seal member being formed with an opening of predetermined diameter to snugly receive one of said wires, means to permit motion of said seal member throughout a plane perpendicular to the direction of wire travel through said seal member, second seal means separating said vacuum and enamel chambers from each other, die plate means at the exit end of said enamel chamber, said first and second seal means defining said vacuum chamber and said second seal means and said die plate means defining said enamel chamber, and means to pressurize said enamel chamber and to contain said enamel within its chamber under said pressure and to maintain said chamber full of enamel only.

2. The cell of claim 1, and means to control the temperature of said enamel in said enamel chamber.

3. The cell of claim 2, said temperature control means comprising a double walled heat jacket surrounding all four sides of said enamel chamber and means to flow fluid at a predetermined temperature through said heat jacket.

4. The cell of claim 2, said temperature control means comprising conduit means for flowing heat control fluid at predetermined temperature through said jacket and around said enamel chamber, said pressurized enamel supply means comprising a conduit nesting within said temperature fluid conduit and extending into said enamel chamber.

5. The cell of claim 1, wherein said die plate is formed with a plurality of die openings, whereby said cell can coat a plurality of said wires simultaneously.

6. The cell of claim 1, means to cure or complete said enamel coating on said wire, and means to pass the enamel coated wire from said cell to said curing or completing means.

7. The cell of claim 6, wherein said enamel is an RCP, and said curing means comprises radiation means to cure said RCP.

8. The cell of claim 6, wherein said enamel is completed by the application of heat, and said completing means comprises heating means.

9. The cell of claim 1, wherein said pressurizing means maintains pressure in said cell is in the range of 0 psi to 100 psig.

10. The cell of claim 9, wherein said pressurizing means maintains pressure in said cell in the range of about 3 psig to about 15 psig.

11. The cell of claim 1, wherein said means to permit motion comprises a support plate having an opening substantially larger in diameter than said wire diameter and substantially smaller in diameter than said seal disc, said support plate formed with a recess larger in diameter than said seal disc diameter and arranged concentrically in tandem with said support clearance plate opening, said seal disc having a thickness in the direction of wire travel substantially equal to the depth of said recess in said support plate, rail means on the wire entrance side of said support plate in predetermined spaced relation to said recesses, and a lock member operatively cooperable with said rail means and said seal discs to hold said seal discs loosely enough to permit motion of said discs in said recesses while the machine on which said cell is mounted is being strung for start up and to thereafter seal the entrance end of said vacuum chamber when vacuum is applied thereto.

12. A cell for coating enamel onto a plurality of strands of bare wire in a continuous operation, said cell comprising a vacuum chamber arranged vertically seriatim before a pressurized, heat jacketed enamel chamber in the direction of wire motion through said cell, first seal means to permit entry of said plurality of strands of wire into said vacuum chamber comprising an individual seal disc for each wire strand formed with an opening of predetermined diameter to snugly receive said one of said wires, each said disc being located substantially concentrically in a recess formed in a plate each said plate recess being larger in diameter than said seal disc diameter said plate being formed with an opening for each wire substantially larger in diameter than said wire diameter and substantially smaller in diameter than said seal disc wire opening, each pair of said opening in said seal disc and plate recess being generally axially aligned with each other to permit passage of said wire through said openings, said seal disc having a thickness in the direction of wire travel substantially equal to the depth of said recess in said plate, rail means on the wire entrance side of said plate in predetermined spaced relation to said recesses, and a lock member operatively cooperable with said rail means and said seal discs to hold said seal discs loosely enough to permit motion of said discs throughout a plane perpendicular to the direction of wire travel while the machine on which said cell is mounted is being strung for start-up and to thereafter seal the entrance end of said vacuum chamber when vacuum is applied thereto, second seal means separating said vacuum and enamel chambers from each other, die plate means at the exit end of said enamel chamber, said first and second seal means defining said vacuum chamber and said second seal means and said die plate means defining said enamel chamber, and means to pressurize said enamel chamber and to contain said enamel within its chamber under said pressure and to maintain said chamber full of enamel only.

* * * * *

UNITED STATES PATENT AND TRADEMARK OFFICE

CERTIFICATE OF CORRECTION

PATENT NO. : 4,258,646

DATED : March 31, 1981

INVENTOR(S) : H. A. Kloczewski and C. N. Schaeffer

It is certified that error appears in the above-identified patent and that said Letters Patent are hereby corrected as shown below:

In the Claims:

Claim 9, column 6, line 39; should read "means maintains pressure in said cell in the range of 0".

Claim 11, column 6, line 50; should read "-cally in tandem with said support plate open-".

Signed and Sealed this

Thirtieth Day of June 1981

[SEAL]

Attest:

RENE D. TEGTMEYER

Attesting Officer

Acting Commissioner of Patents and Trademarks